United States Patent [19]

Hintze et al.

[11] Patent Number: 5,025,773

[45] Date of Patent: Jun. 25, 1991

[54] ARCHERY ARROW SUPPORT

[76] Inventors: Kurt Hintze, 220 Carmichael Dr., Woodstock, Ga. 30188; Keith Hacker, 237 Lamplighter La., Marietta, Ga. 30067

[21] Appl. No.: 248,735

[22] Filed: Sep. 26, 1988

[51] Int. Cl.[5] ..... F41B 5/00

[52] U.S. Cl. ..... 124/445; 124/24.1

[58] Field of Search ..... 124/24 R, 41 A, 86, 124/88, 24.1, 44.5

[56] References Cited

U.S. PATENT DOCUMENTS

| | | | |
|---|---|---|---|
| 3,406,675 | 10/1968 | Fredrickson | 124/24 R |
| 4,236,497 | 12/1980 | Troncoso | 124/24 R |
| 4,282,850 | 8/1981 | Warnicke | 124/24 R |
| 4,324,221 | 4/1982 | Peck | 124/24 R |
| 4,351,311 | 9/1982 | Phares | 124/41 A |
| 4,372,282 | 2/1983 | Sanders | 124/24 R |
| 4,421,092 | 12/1983 | Christian | 124/41 A |
| 4,489,704 | 12/1984 | Toncoso, Jr. | 124/24 R |
| 4,492,214 | 1/1985 | Kielhoffer | 124/24 R |
| 4,569,325 | 2/1986 | Christian | 124/41 R |
| 4,598,688 | 7/1986 | Paul et al. | 124/41 A |
| 4,632,087 | 12/1986 | Cline | 124/88 |
| 4,662,346 | 5/1987 | Laffin | 123/41 A |
| 4,759,337 | 7/1988 | Suski | 124/24 R |
| 4,838,237 | 6/1989 | Cliburn | 124/41 A |
| 4,917,072 | 4/1990 | Chang | 124/24.1 |

*Primary Examiner*—Peter M. Cuomo
*Assistant Examiner*—John A. Ricci
*Attorney, Agent, or Firm*—Thomas, Kerr & Kayden

[57] ABSTRACT

An arrow rest for use with an archery bow comprises a mounting member attached to the bow handle and extending rearwardly thereof and a yoke adjustably and pivotably mounted to the rear end portion of the mounting member. The yoke defines a radially accesible opening having a central axis and a pair of pedestals are mounted to the yoke extending into the opening with the pedestals positioned to support an arrow. A resilient retaining member extends into the opening in substantially opposing relationship relative to the pedestals. The resilient retaining member is positioned to limit lateral movement of an arrow extending along the central axis of the yoke so that the arrow is maintained in the arrow rest prior to and during launch. The resilient retaining member flexes to one side in response to movement of an arrow into the arrow rest to allow the arrow to fall into place on the pedestals, whereupon the retaining member returns to its unflexed configuration to maintain the arrow in place.

10 Claims, 3 Drawing Sheets

Fig 3
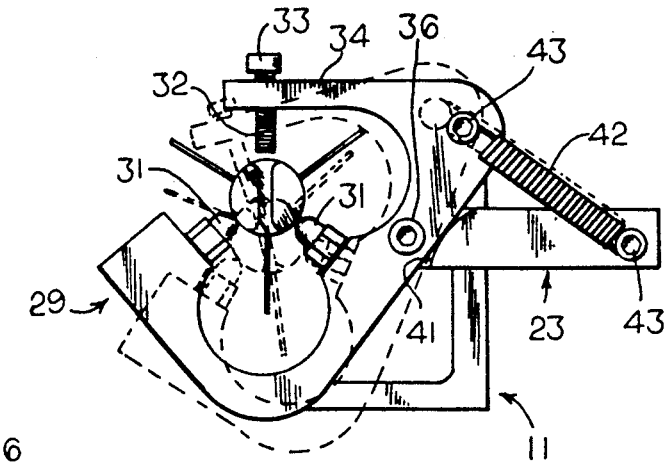
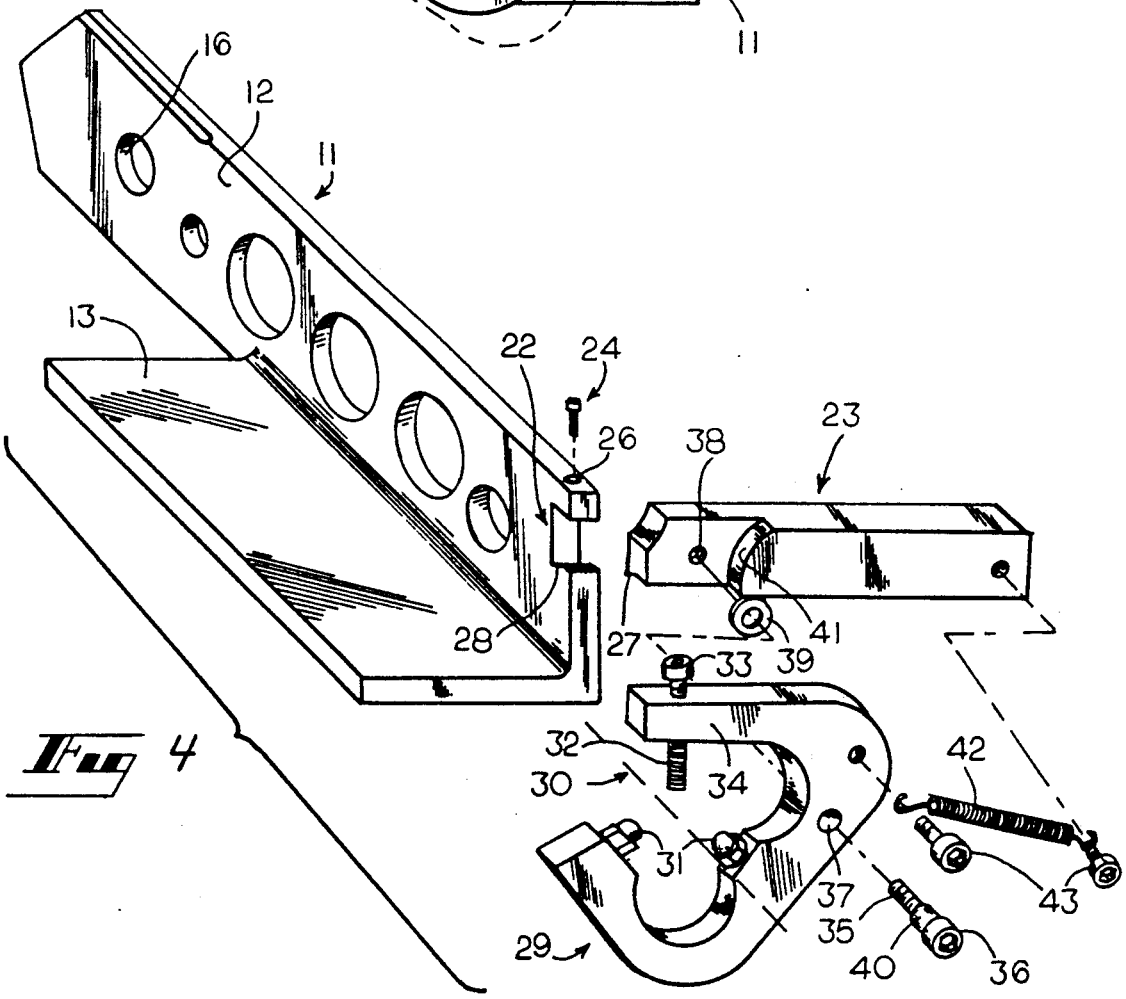
Fig 4

ARCHERY ARROW SUPPORT

TECHNICAL FIELD

The present invention relates to archery equipment and more particularly to an arrow support and guide for an archery bow.

BACKGROUND OF THE INVENTION

Archery bows for use in hunting and target practice have been in use for centuries. Typically, such bows have included an elongated body with a bowstring tensioned between its ends and a handle portion intermediate its ends. The handle portion usually defines a bow shelf upon which an arrow is supported during launch from the bow.

Several problems have long been associated with the use of traditional bows and particularly with use of traditional bow shelves to support an arrow. Since the shelf is commonly only an indention formed in the handle portion of the bow, there is usually no means for holding the arrow on the shelf. As a consequence, the bow must be loaded each time it is shot and, if the arrow is not smoothly drawn and released, it can fall from the shelf prior to or during launch. Further, an arrow moving across the surface of the bow shelf tends to encounter friction which can degrade the accuracy, velocity and range of the arrow. In addition, if the arrow nock is not placed on the bow string such that the arrow is precisely aligned with the shelf, the arrow shaft tends to move past the shelf at an angle imparting lateral forces to the arrow and further degrading its accuracy. Finally, the fletching extending outwardly from the rear end portion of the arrow tends to brush the handle portion of the bow or the shelf as the arrow leaves the bow introducing still further uncertainty in the accuracy of the arrow.

Various arrow support devices have been proposed in the past to overcome some of the above discussed problems. U.S. Pat. No. 4,324,221 of Peck, for example, discloses an arrow rest that mounts to a bow handle portion above the bow shelf and includes a pair of opposed cone shaped rollers between which the arrow is supported and guided during launch. U.S. Pat. No. 4,569,325 of Christen and U.S. Pat. No. 4,598,688 of Paul et al disclose arrow rests in which an arrow is supported vertically during launch atop a substantially vertically oriented roller and laterally by a horizontally oriented roller or pin. Further examples are illustrated in U.S. Pat. Nos. 4,282,850 of Warnicke, 4,372,282 of Sanders and 3,406,675 of Fredrickson.

While the devices disclosed in the above listed patents have been partially successful in improving arrow accuracy, they nevertheless tend to have certain shortcomings of their own. In particular, arrow rests that include a pair of rollers or supports upon which the arrow rests during launch include no means for maintaining the arrow in place on the rollers prior to and during launch so that the bow must still be loaded each time it is shot. Further, if the arrow is not smoothly drawn and released, it can fall from the rollers during launch and, in some instances, can impale an archer's hand adjacent the bow handle. Devices such as that shown in Warnicke which include flexible fins for holding the arrow in place tend to degrade arrow accuracy because of friction introduced to the moving arrow by the fins.

There is, therefore, a perceived need for an improved arrow rest adapted to hold a nocked arrow in ready to launch position prior to launch and guide the arrow accurately from the bow during launch. It is to the provision of such an arrow rest that the present invention is primarily directed.

SUMMARY OF THE INVENTION

The present invention comprises an improved arrow rest for use with an archery bow of the type having a bow body, a handle portion intermediate the ends of the bow body and a bow string tensioned between the ends of the bow. The arrow rest includes a mounting member attached at one end to the bow handle portion and extending rearwardly thereof to a position between the handle portion and the bowstring. Adjustably mounted to the rear end portion of the mounting member is a yoke that defines a radially accessible opening having a substantially central axis. A pair of pedestals are mounted to the yoke and extend into the opening on one side of the axis with the pedestals positioned to support an arrow extending substantially along the central axis when the bow is held by an archer in its substantially vertical arrow launching orientation.

A resilient retaining member is mounted to the yoke and extends into the opening on another side of the axis in substantially opposing relationship relative to the pedestals. The resilient retaining member is radially adjustable relative to the central axis and is normally positioned to limit lateral movement of an arrow extending along the central axis such that the arrow is loosely constrained by the retaining member and the pedestals and thereby held within the rest prior to and during launch.

The yoke is pivotally mounted so as to be pivotable in a substantially longitudinal direction relative to the bow body and is spring biased to a preselected longitudinal position.

In operation, an arrow can be loaded into the arrow rest by moving it radially into the opening toward the central axis. As the arrow moves toward the axis, it contacts one of the pedestals and the resilient retaining member whereupon the retaining member flexes to one side allowing the arrow to move further and fall into place along the axis and resting on the pedestals. With the arrow in place, the retaining member returns to its unflexed configuration with its end portion positioned adjacent the shaft of the arrow to limit lateral movement of the arrow. The arrow shaft is thereby constrained between the pedestals and the retaining member such that upon placement of the arrow nock on the bowstring, the arrow is held in place in the arrow rest in a ready-to-launch position.

To launch the arrow, the bow is raised by an archer to its vertical arrow launching orientation and the bowstring and nocked arrow is drawn rearwardly by the archer pulling the arrow shaft rearwardly through the arrow rest. Upon release of the bowstring, the arrow moves through the arrow rest atop the pedestals with the yoke pivoting in response to lateral flexing induced in the shaft of the arrow by the force of the launch. The arrow is consequently guided by the arrow rest as it is launched from the bow and the fletching extending outwardly from the rear end portion of the arrow passes through the opening defined by the yoke as the arrow leaves the arrow rest.

Thus, it is seen that an improved arrow rest is now provided that is easily loadable by moving the arrow radially into the yoke and onto the pedestals and, once loaded, the arrow is held within the arrow rest by the pedestals and the retaining member. During launch, the arrow is constrained by the restraining member so that it cannot fall from the pedestals and the pivotably mounted spring biased yoke moves in response to lateral flexing of the arrow shaft to reduce extraneous lateral forces and thereby improve arrows accuracy and flight characteristics. Other objects, features and advantages of the present invention will become apparent upon reading the following specification in conjunction with the drawings.

BRIEF DESCRIPTION OF THE DRAWINGS

FIG. 3 is a rear elevational view of the arrow rest illustrating the spring biased pivotal movement of the yoke member.

FIG. 4 is an exploded perspective view of the arrow rest showing relationships between various components thereof.

DESCRIPTION OF THE PREFERRED EMBODIMENT

Figure 1:
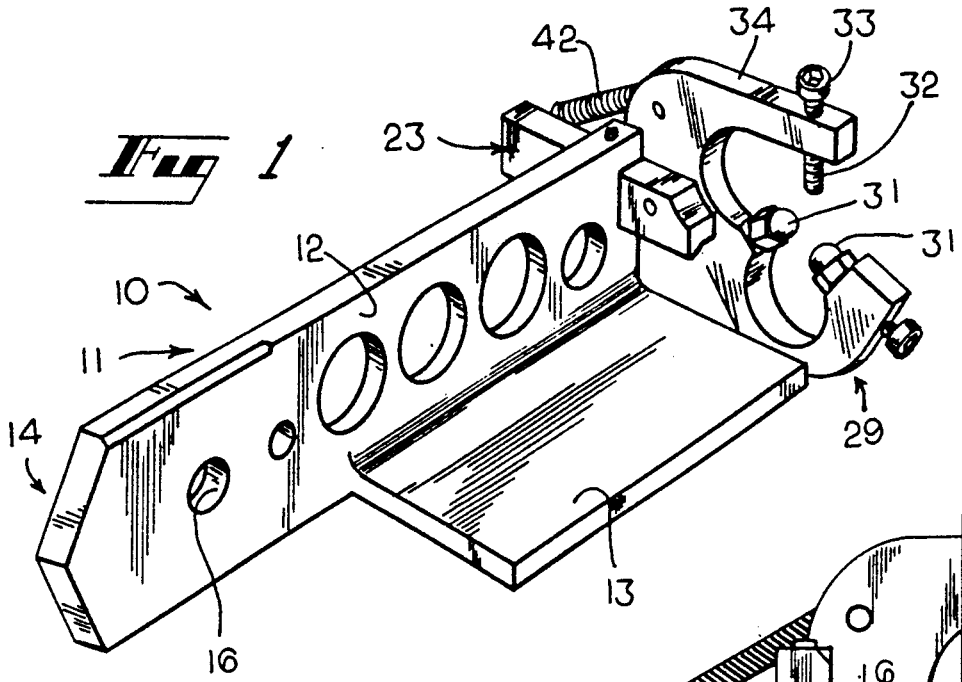
FIG. 1 is a perspective view of the arrow rest showing the mounting member and the pivotally adjustably mounted yoke.

Referring now to the figures in which like numerals represent like parts throughout the several views, the arrow rest 10 is seen in FIG. 1 to comprise a mounting member 11 with a substantially L-shaped cross section defined by a vertically oriented portion 12 and a horizontally oriented portion 13. The front end portion 14 of the mounting member 11 is adapted to be secured to a bow handle 17 (FIGS. 2A and 2B) in the conventional way with a bolt 18 extending through an aperture 16 in the mounting member and secured in a threaded aperture 19 provided in the bow handle. When attached to the bow handle as described, the mounting member 11 extends rearwardly of the handle 17 to a position intermediate the handle 17 and the bow string 21.

As best seen in FIG. 4, the rear end portion of the mounting member 11 is formed to define a slot 22 sized and shaped to receive a crossbar 23 such that the crossbar 23 is laterally movable relative to the mounting member within the slot 22. A threaded bore 26 is formed in the mounting member adjacent the slot 22 and extends from the top of the vertically oriented portion 12 through the mounting member to the upper face of the slot 22. The threaded bore 26 is adapted to receive a threaded set screw such that the set screw 24 can be threaded into bore 26 until its lower end portion protrudes into the slot 22. In this way, the crossbar 23 can be secured with the set screw 24 in a preselected lateral position within the slot 22.

A longitudinally extending tapered lip 27 depends from the bottom of the crossbar 23 and a corresponding dovetail notch 28 is formed adjacent a back wall of the slot 22 such that the tapered ridge 27 dovetails into the notch 28 when the crossbar is inserted laterally into the slot 22. In this way, the crossbar 23 is constrained to lateral movement only within the slot 22.

A yoke 29 is formed to define a laterally accessible opening having a substantially central axis 30. A pair of pedestals 31 are mounted to the yoke and extend into the opening on the lower side of the axis 30 in FIG. 4. As seen in FIG. 3, the pedestals 31 are positioned to support an arrow extending substantially along the central axis 30 when the bow is in its vertical arrow launching orientation. The yoke 29 further includes an upper arm 34 that bounds the top portion of the opening. An adjustment screw 33 is threaded through a threaded aperture formed in the upper arm 34 such that its lower end extends into the opening. A tightly wound coil spring retaining member 32 is mounted to the lower end portion of the adjustment screw 33 and extends further into the central opening in substantially opposing relationship relative to the pedestals 31. The lower end portion of the spring 32 is thus laterally adjustable by rotating the adjustment screw 33 within the threaded opening in the arm 34. While the preferred embodiment employs a coil spring retaining member, it will be understood that other resilient elements such as, for example, a length of spring steel, could be used in place of the spring with equally acceptable results.

The yoke 29 is pivotally mounted to the crossbar 23 via a pivot screw 36 that has a threaded portion 35 and an unthreaded shank portion 40. The shank portion 40 is slightly longer than the width of the yoke such that when extending through the opening 37 in the yoke 29 and secured in threaded hole 38 in the crossbar, the yoke 29 is free to pivot about the shank portion 40 of the pivot screw 36. A washer 39 is disposed between the yoke 29 and the crossbar 23 to space the yoke slightly from the surface of the crossbar so that the yoke can pivot freely about the pivot screw 36 without interference from the crossbar. A stop 41 is formed in the crossbar 23 adjacent the pivotally attached yoke to limit pivotal movement of the yoke between a first upwardly pivoted position and a second downwardly pivoted position (FIG. 3).

A coil spring 42 extends between the end portion of the cross bar 23 an upper portion of the yoke at a location above its pivotal attachment to the crossbar. The yoke 29 is thus yieldably biased by the spring 42 to its upwardly pivoted position by spring 42 such that upon application of downward force, the yoke 29 pivots downwardly and, upon dissipation of the downward force, moves back to its upwardly pivoted position under the influence of the coil spring 42. The end portions of the spring 42 are attached to the cross bar 23 and the yoke 29 respectively with a pair of attaching screws 43. While the stop 41 in the preferred embodiment is seen to comprise a lip formed in the cross bar, other stop means such as, for example, limit screws or pins could be substituted with similar results.

As best seen in FIG. 3, the opening defined by yoke 29 is formed with angularly spaced lobes sized to pass the fletching of an arrow moving through the arrow rest along the central axis of the opening so that the fletching does not contact any portion of the arrow rest during launch of the arrow. In this way, no extraneous lateral forces are imparted to the arrow through the fletching and the accuracy of the arrow is increased.

OPERATION

Figure 2B:
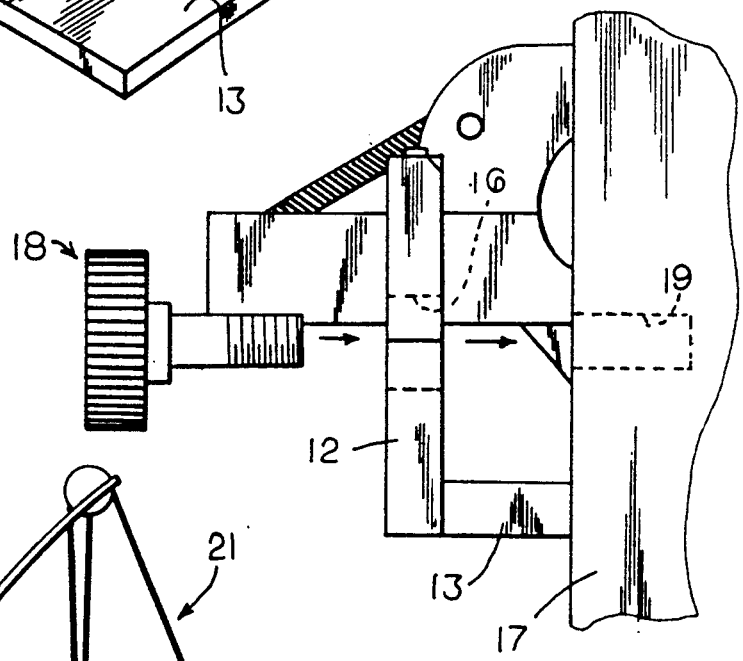
FIG. 2*b* is a partial front elevational view of the bow of FIG. 2*a* showing a method of mounting the arrow rest to the bow.
Figure 2A:
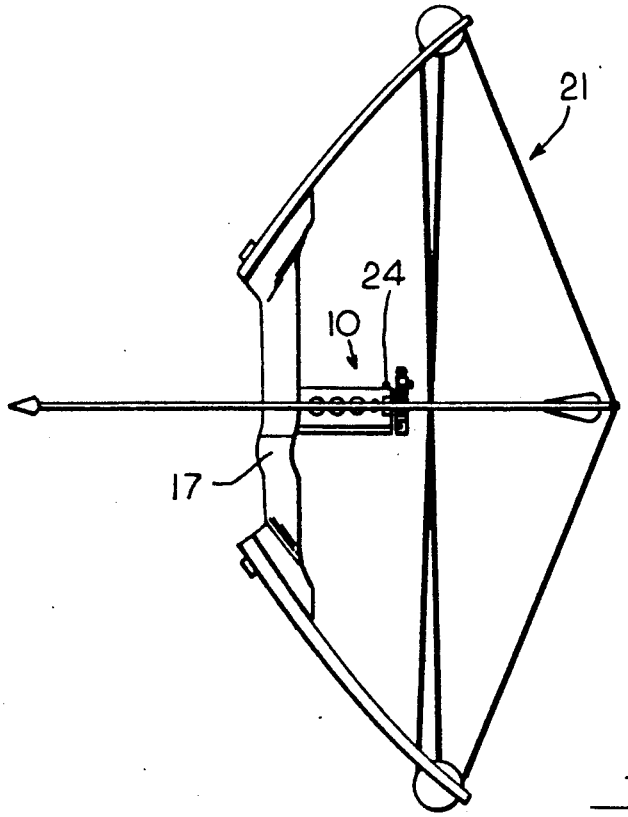
FIG. 2*a* is a side elevational view of the arrow rest mounted to a bow and supporting a launch prone arrow.
Figure 5A:
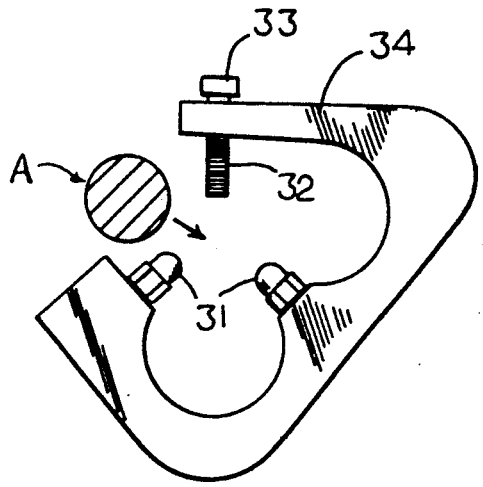
FIGS. 5*a* through 5*c* illustrate successive steps in loading an arrow into the arrow rest.
Figure 5B:
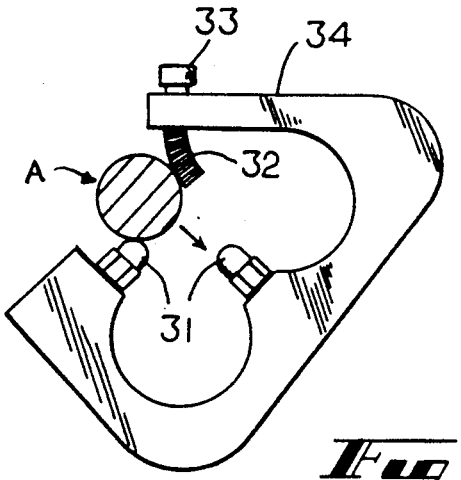
Figure 5C:
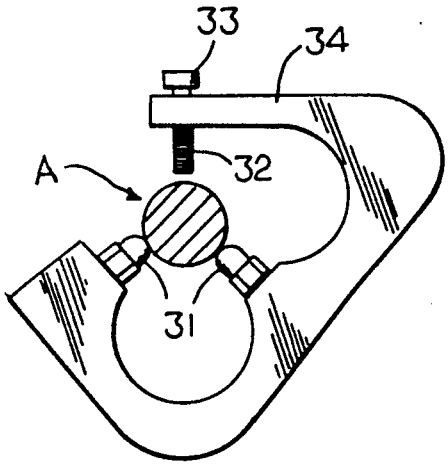

In use, the arrow rest of the present invention is mounted to an archery bow as shown in FIGS. 2A and 2B such that the yoke portion of the arrow rest is positioned between of the bow handle and the bowstring. The yoke can be adjusted laterally relative to the bow by loosening the set screw 24 and moving the cross bar 23 within the slot 22 until the yoke is located at the desired lateral position. As best seen in FIGS. 5*a* through 5*c*, once the arrow rest has been mounted to the bow and adjusted, an arrow A can be loaded into the arrow rest by moving the arrow radially into the opening (FIG. 5*a*) until the arrow contacts one of the pedestals 31 and the resilient retaining member 32. Upon further radial movement of the arrow A, the resilient retaining member 32 flexes to one side (FIG. 5*b*) to allow the arrow to move into place on the pedestals 31. Upon movement of the arrow shank onto the pedestals, the resilient retaining member 32 returns to its unflexed configuration (FIG. 5*c*) with its end portion located adjacent the arrow. With the arrow thus loaded, and the nock of the arrow positioned on the bowstring, lateral movement of the arrow is limited by the two pedestals and the retaining member so that the arrow cannot fall out of the arrow rest prior to or durding launch. An archer can then carry the loaded bow with the nocked arrow maintained within the arrow rest by the pedestals and the retaining member in a ready to launch position. When the archer desires to launch the arrow at a target, the bow is typically raised to a vertically oriented arrow launching position as shown in FIG. 2*a* and the string and arrow are drawn rearwardly of the bow with the arrow resting and sliding on the pedestals 31.

Upon release of the bowstring, the force imparted to the arrow by the string causes the arrow to flex laterally along its length as it travels past the arrow rest. As each of these flex points passes the pedestals, downward force is exerted on the pedestals and the yoke causing the yoke to pivot about the pivot screw 36. When the flexed point has passed the yoke, the spring 42 urges the yoke back to its biased pivotal position. In this way, the arrow rides smoothly over the pedestals 31 with forces resulting from the flexed arrow shaft are transmitted into the responsively pivoting yoke and not into the arrow itself. Lateral forces on the arrow as it leaves the bow are thus greatly reduced and, consequently, the accuracy, velocity and range of the arrow is increased. As the rear end portion of the arrow passes through the opening the arrow fletching extends outwardly into the lobed portions of the opening defined by the yoke. The fletching thus passes through the opening and does not come in contact with any portion of the bow or the arrow rest. Lateral forces imparted to the arrow through the arrow fletching are thus eliminated further improving the accuracy and range of the arrow.

Figure 6:
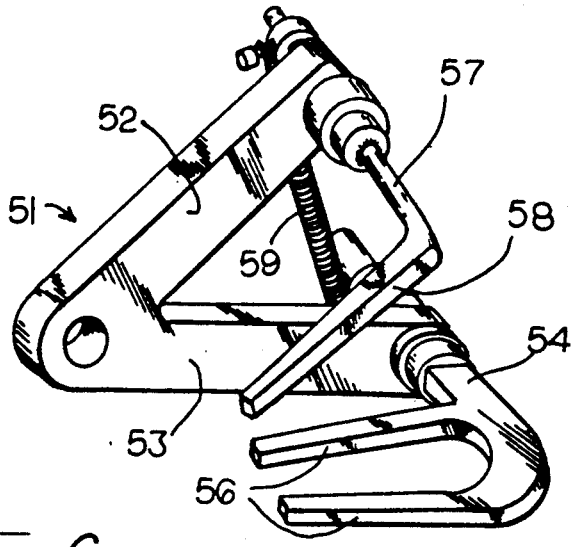
FIG. 6 illustrates an alternate embodiment of the arrow rest with spring biased confronting prongs for holding and guiding an arrow.

In the embodiment of FIG. 6, the mounting member 51 is seen to be formed in the shape of a V and is adapted to be mounted at its apex to the bow handle with the legs 52 and 53 of the V-shaped mounting member extending rearwardly of the handle. Pivotally mounted to the end portion of the lower leg 53 is a pivot rod 54 bearing a pair of prongs 56 that extend upwardly and forwardly relative to the mounting member. The end portions of the prongs are spaced to support an arrow.

The end portion of the upper leg 52 has a pivot rod 57 that is pivotally mounted to the mounting member and bears a single prong 58 that extends forwardly and downwardly relative to the mounting member such that its end portion is positioned adjacent the end portions of the prongs 56. Stops (not shown) are positioned to limit inward pivotal movement of the prongs and a spring 59 is mounted to bias the prongs to their inwardly pivoted positions with their end portions adjacent. With this arrangement, an arrow can be moved onto the prongs 56 and the end portion of the upper prong 58 is spring biased into engagement with the arrow to maintain it in place upon the lower prongs. Upon launch, the arrow is guided by the prongs from the bow and the prongs pivot in response to lateral flexing of the arrow to increase the accuracy of the launched arrow.

The invention has been described in terms of preferred embodiments. It will be obvious to those of skill in the art that many changes, deletions and additions can be made to the preferred embodiments without departing from the spirit and scope of the invention as set forth in the claims.

We claim:

1. An arrow rest for use with an archery bow for maintaining an arrow in a ready-to-launch position and for guiding the arrow from the bow upon launch, said arrow rest comprising:

a mounting member having a front end portion and a rear end portion with said mounting member being adapted to be mounted at its front end portion to the bow with its rear end portion positioned rearwardly of the bow;

a yoke defining a radially accessible opening having a substantially central axis;

means for adjustably mounting said yoke to said mounting member rear end portion to locate said yoke in a predetermined position relative to the bow;

first and second pedestals mounted to said yoke and extending into said opening on one side of said axis with said pedestals being positioned to support an arrow extending substantially along said central axis when the bow is in a vertically oriented arrow launching orientation; and means for limiting lateral movement of an arrow resting on said pedestals, said means comprising a resilient retaining member mounted to said yoke on another side of said central axis opposing said first and second pedestals with said retaining member extending into said opening to a first position adjacent to and spaced from the arrow, said resilient retaining member being adapted to flex as an arrow is moved radially into said yoke to allow the arrow to fall into position on said pedestals and thence to return to its unflexed configuration for limiting lateral movement of the arrow, whereby prior to launch, a nocked arrow is loosely constrained within said arrow rest between said pedestals and said retaining member and during launch the arrow rests on and is guided from the bow by said pedestals without interference from said retaining member.

2. The arrow rest of claim 1 wherein said means for adjustably mounting said yoke to said mounting member comprises an elongated crossbar laterally movably mounted to said mounting member rear end portion with said yoke being mounted to said crossbar.

3. The arrow rest of claim 2 wherein said mounting member rear end portion defines a slot having a size and shape corresponding substantially to the cross-sectional shape of said crossbar and adapted to receive said crossbar within said slot in sliding cooperation with said slot, and wherein said mounting member further includes means for maintaining said crossbar in a preselected lateral position relative to said mounting member.

4. The arrow rest of claim 3 wherein said yoke is pivotally mounted to said crossbar and wherein said crossbar includes stop means positioned to restrict pivotal movement of said yoke between a first position and a second position, and spring means for yieldably biasing said yoke to said first position whereby said pedestals normally support the arrow with said yoke in said spring biased first position and during launch of the arrow, said yoke pivots in response to lateral flexing of the arrow to guide accurately the arrow from the bow.

5. The arrow rest of claim 4 wherein said resilient retaining member is radially adjustable relative to said central axis.

6. The arrow rest of claim 5 wherein said retaining member comprises a coil spring extending radially into said opening whereby said coil spring flexes in response to radial movement of an arrow into said central opening to allow the arrow to move into place on said pedestals whereupon said coil spring returns to its unflexed position with the pedestals and the retaining member limiting lateral movement of the arrow to maintain the arrow within the arrow rest.

7. The arrow rest of claim 6 wherein said opening is sized and shaped to pass the fletching of an arrow moving along said central axis.

8. An arrow rest for use with an archery bow for maintaining an arrow in a launch prone position and guiding the arrow from the bow upon launch, said arrow rest comprising:

a mounting member having first and second end portions and being adapted to mount at its first end portion to the bow handle with its second end portion extending rearwardly of the bow handle;

a yoke member defining a radially accessible opening having a central axis and including a pair of spaced pedestals extending into said opening and spaced to support the arrow, said yoke member further including a resilient retaining member mounted in substantially opposing relationship relative to said pedestals and extending into said opening to a position adjacent to and spaced from an arrow supported on said pedestals, said opening being sized and shaped to pass the fletching of an arrow moving along said central axis;

means for adjustably mounting said yoke member to said mounting member second end portion to locate said yoke member in a preselected position relative to said bow, said yoke member being pivotally attached to said means and being yieldably spring biased to a predetermined orientation about its point of pivotal attachment, said resilient retaining member being adapted to flex as an arrow is moved radially into said yoke member to allow the arrow to fall into position on said pair of spaced pedestals and thence to return to its unflexed configuration for limiting lateral movement of the arrow, whereby upon movement of an arrow into said opening, said resilient retaining member flexes to allow the arrow to fall into place upon said pedestals whereupon said resilient retaining member returns to its unflexed configuration wherein said retaining member and said pedestals loosely constrain and restrict lateral movement of the arrow to maintain the arrow in place within the arrow rest and, upon launch of the arrow, the arrow is supported on the pedestals and the yoke pivots about its point of pivotal attachment in response to lateral flexing of the arrow to guide the arrow accurately from the bow without interference from the retaining member.

9. In an archery bow of the type having an elongated bow body, a handle portion and a bowstring, the improvement comprising an arrow rest mounted to said bow and positioned between said handle portion and said bowstring, said arrow rest including a yoke member defining a radially accessible opening having an axis with said yoke member having at least two pedestals extending into said opening on one side of said axis and a resilient retaining member extending into said opening on another side of said axis in substantially opposing relationship relative to said pedestals, said pedestals being positioned to support an arrow thereupon with said resilient retaining member being positioned adjacent to and spaced from the arrow to restrict lateral movement thereof, said resilient retaining member being adapted to flex as an arrow is moved radially into said yoke member to allow the arrow to fall into position on said pair of spaced pedestals and thence to return to its unflexed configuration for limiting lateral movement of the arrow, said yoke member being substantially longitudinally movable relative to said bow body and yieldably biased to a preselected longitudinal positioned, whereby a nocked arrow is loosely constrained and held in place within said arrow rest between the pedestals and the retaining member prior to launch and the arrow is supported by said pedestals during launch with the arrow rest moving in response to lateral flexing of the arrow to guide the arrow accurately from the bow.

10. An arrow rest for use with an archery bow for receiving an arrow, maintaining the arrow in a launch prone position and guiding the arrow from the bow upon launch, said arrow rest comprising:

a yoke formed to define a radially accessible opening having a central axis extending substantially along the direction of intended arrow flight;

pedestal means mounted to said yoke and extending into said opening on one side of said central axis with said pedestal means being configured and positioned to support and guide an arrow from the bow upon launch;

a resilient retaining member mounted to said yoke and extending into said opening on another side of said central axis substantially opposing said pedestal means;

said resilient retaining member being adapted to flex in response to radial movement of an arrow into said opening to allow the arrow to fall into place on said pedestal means and thence to return to its unflexed configuration extending toward the shaft of the arrow to constrain the arrow within the yoke.

* * * * *